United States Patent [19]

Hirayama et al.

[11] Patent Number: 4,746,108

[45] Date of Patent: May 24, 1988

[54] CHOPPER DEVICE FOR USE IN A FOLDER

[75] Inventors: Seiki Hirayama; Shigeaki Kurihara, both of Ibaraki, Japan

[73] Assignee: Komori Printing Machinery Co., Ltd., Tokyo, Japan

[21] Appl. No.: 937,304

[22] Filed: Dec. 3, 1986

[51] Int. Cl.[4] ..... B42C 1/00

[52] U.S. Cl. ..... 270/45; 493/437

[58] Field of Search ..... 270/45–50; 493/419–420, 422, 425, 426, 427, 437

[56] References Cited

U.S. PATENT DOCUMENTS

| | | | |
|---|---|---|---|
| 2,007,209 | 7/1935 | Neidig | 493/437 |
| 2,750,186 | 6/1956 | Bruneau et al. | 493/437 X |
| 3,417,987 | 12/1968 | Hannon | 270/45 X |
| 4,281,828 | 8/1981 | McDonald et al. | 493/437 X |
| 4,647,029 | 3/1987 | Oltmori | 270/45 |

*Primary Examiner*—E. H. Eickholt

*Attorney, Agent, or Firm*—Remy J. VanOphem

[57] ABSTRACT

An improved chopper device for use in a folder for folding a signature which has been subjected to parallel folding at a parallel folding device and then conveyed by means of a conveying belt, in a direction perpendicular to the parallel folding direction. The chopper device is provided with an elongated opening having a mouthpiece below the conveying path therefor. An upwardly and downwardly movable chopper blade lowers when the signature is stopper at a predetermined position and forces the signature into the opening. A pair of rollers is provided below the opening in order to grip the signature forced into the opening by the chopper blade nd deliver it to a delivery conveyor. Brushes are provided on both sides of the opening thereabove so as to slidably hold both sides of the signature when the signature is lowered by the rollers through the opening. Such an arrangement permits both side edges of the signature which has been released from the condition where it is held by the conveying belt to enter into the opening while sliding on the brushes.

8 Claims, 4 Drawing Sheets

CHOPPER DEVICE FOR USE IN A FOLDER

BACKGROUND OF THE INVENTION

The present invention relates to a chopper device used in a folder for a web-fed rotary printing press, and more particularly to a chopper device therefor which half-folds a signature conveyed after having been subjected to parallel folding, in a direction perpendicular to the parallel folding direction.

In a web-fed rotary printing press, there is provided in association therewith a folder which cuts a web, i.e., a roll of printing sheet which has undergone a printing process, into sheet segments having a predetermined size and then folds the sheet segments. The folder is provided with a former device for half-folding a web which has not been subjected to a cutting process in the sheet width direction, a parallel folding device to cut, in the length direction, a web which has undergone former folding or a web which has been cut in the sheet width direction using a slitter and then folded into sheet segments in the length direction, a chopper device to further fold, in a direction perpendicular to the parallel folding direction, signatures which have been subjected to parallel folding, and an apparatus for conveying the sheet segments, or signatures.

The chopper device which is the subject matter of the present invention operates as follows. First, a front edge of a signature is conveyed, by a conveying belt after being subjected to parallel folding, into contact with a front lay, thereby stopping the signature. Next a thin plate-like chopper blade is lowered toward the centerline of the stopped signature to cause the signature to be seized between a pair of rotary rollers so as to half-fold the signature. The signatures which have been subjected to half-folding as described above are delivered between paddles of a rotating fan wheel. Thus, they turn around along with the fan wheel and are delivered onto a delivery conveyor. Then, they are conveyed therefrom and are stacked.

With a conventional chopper device used in a folder, the following problem occurs. The signature, which is struck at its centerline by the chopper blade and then seized between the rotary rollers to undergo folding, is held or retained by the conveying belt at the beginning of the folding. However, since the signature is released from being held by the conveying belt at the end of folding, edge portions of the signature will rapidly lower, thereby contacting both sides of the structure by which the chopper blade is fitted. This invites the possibility that the printed surface of the edge portions will be strained or broken, resulting in generation of waste printed sheets.

SUMMARY OF THE INVENTION

It is, therefore, an object of the present invention to provide a chopper device for use in a folder which has eliminated the drawbacks encountered with the above-mentioned prior art.

According to the present invention, there is provided a chopper device for use in a folder adapted to apply chopper folding to a signature which has been subjected to parallel folding at a parallel folding device. The signature is conveyed by means of a conveying belt, in a direction perpendicular to the parallel folding direction, to an elongated opening having a mouth-piece which is provided in the conveying direction below the conveying path for the signatures. An upwardly and downwardly movable chopper blade lowers when the signature has stopped at a predetermined position, to force the signature into the elongated opening. A pair of rollers, provided below the opening, are in contact with each other, and rotate in directions opposite to each other, respectively, in order to seize the signature forced into the elongated opening by the chopper blade and deliver it to a delivery conveyor. Brushes provided on both sides of the elongated opening thereabove, are disposed in parallel relation to the chopper blade and slide on the sheet surface of the signature.

DETAILED DESCRIPTION OF THE PREFERRED EMBODIMENT

A preferred embodiment according to the present invention will be described in detail with reference to FIGS. 1 to 4.

Figure 1:
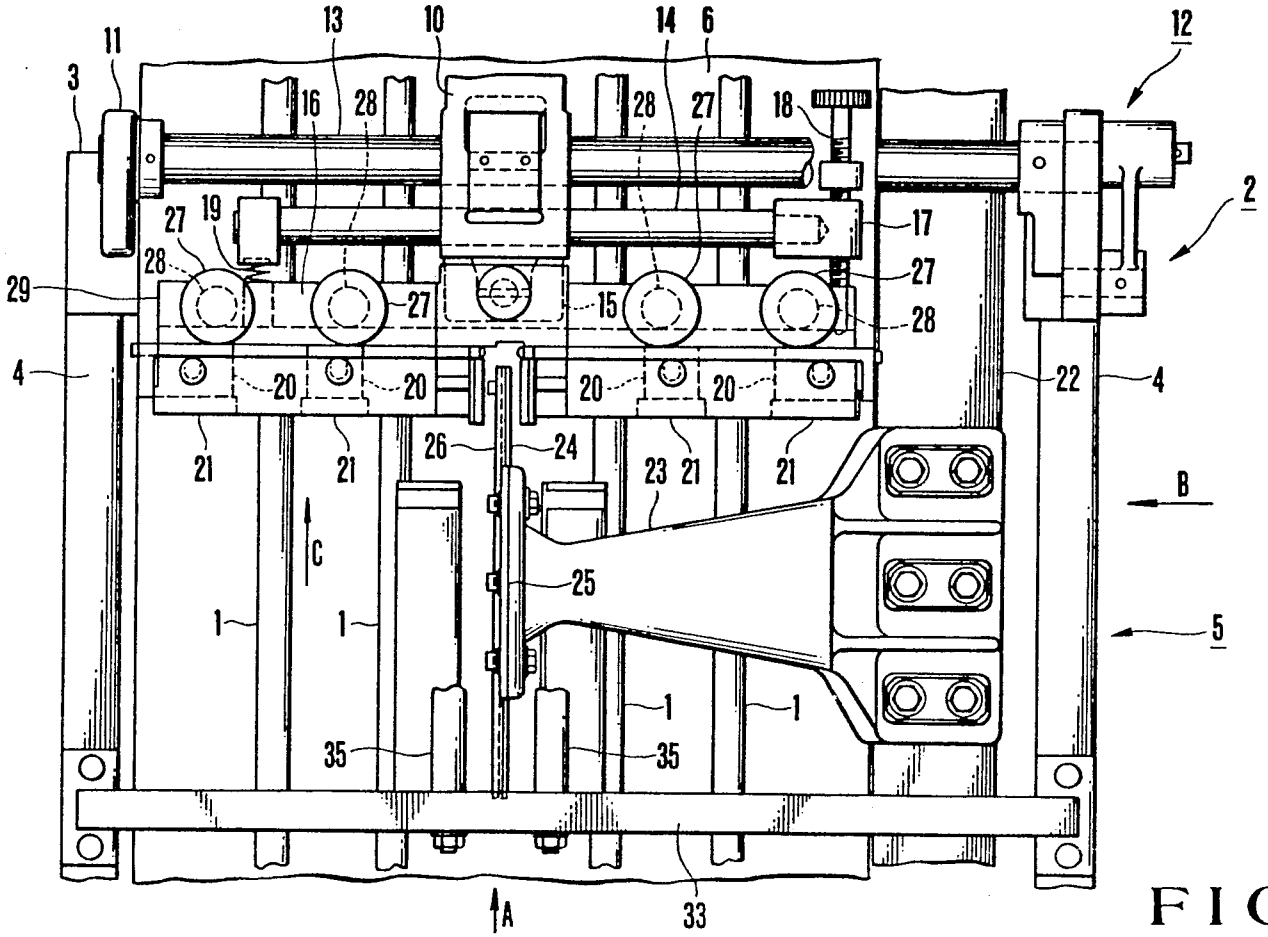
FIG. 1 is a plan view illustrating a chopper device to which the present invention is directed wherein indication of the support structure of the brushes for holding the signature is omitted.
Figure 2:
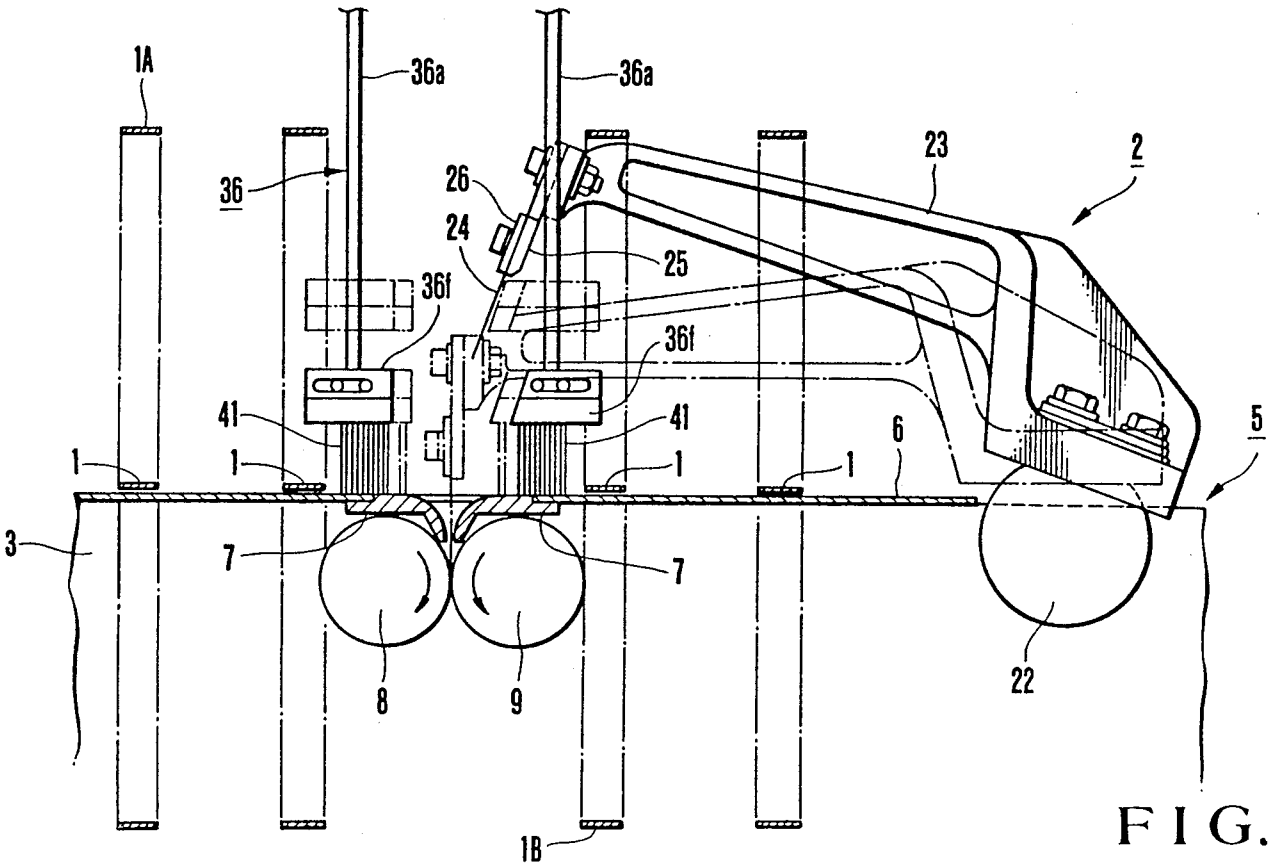
FIG. 2 is a front view taken along arrow A of FIG. 1.
Figure 3:
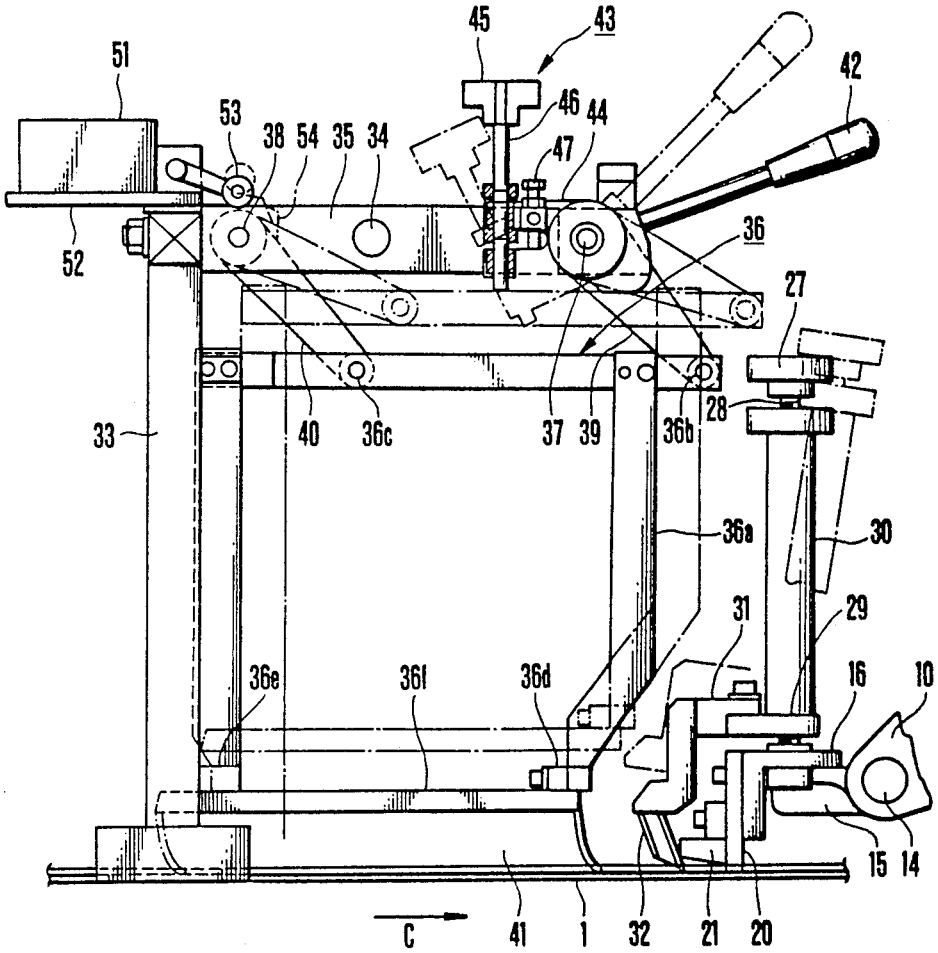
FIG. 3 is a side view showing a signature holding brush and the vicinity of its support structure, taken along arrow B of FIG. 1.

As seen from these figures, between a parallel folding device (not shown) and an end portion of a signature delivery device (not shown) there is provided a folder having four conveying belts 1, each of which consists of one pair of conveying belts, i.e., upper and lower belts, running in a direction indicated by arrow C in FIGS. 1 and 3. Portions indicated by reference numerals 1A and 1B in FIG. 2 show cross-sections in the return paths of the conveying belts 1, respectively. Signatures which have been subjected to parallel folding are conveyed while being held by the upper and lower belts of the conveying belts 1. The conveying belts 1 release the signatures from the condition where they are held at a chopper device or at a signature delivery device, which will be described later, and then return the signatures to the parallel folding device via the return paths.

In the middle of the path along which the signatures are conveyed by the conveying belts 1, there is provided a chopper device, the entirety of which is represented by reference numeral 2. The chopper device 2 is provided with a subframe 5 having a frame structure formed with a vertically elongated rectangular side plate 3 and square stays 4, as shown in FIG. 1, for joining four corners positioned at upper, lower, left and right portions. The subframe 5 is supported by a chopper frame (not shown) so that it is movable and adjustable in correspondence with the size of the signature. A plate 6 is installed such as to be supported by the subframe 5 to allow the conveying belts 1 to slide thereon. A rectangular hole is formed in the central portion of the plate 6. A pair of mouthpieces 7 are screwfastened on either side of the hole. Between the left and right mouthpieces 7, there is formed a groove or an opening for passing therethrough a chopper blade 24, which is movable upwardly and downwardly, as will be described later herein. In addition, below the mouthpieces 7, a pair of jaw rollers 8 and 9, rotating in directions indicated by respective arrows in FIG. 2, are disposed.

An arm 10 shown in FIGS. 1 and 3 is disposed at the front side in the center of the subframe 5, in the width direction thereof. The arm 10 is supported by a horizontal support shaft 13, both end portions of which are supported by a support member 11 and a manipulation member 12; the central portion of the supporting end thereof is fixed to the support shaft 13. Manipulation of the manipulation member 12 causes the support shaft 13 to rotate, thus fluctuating the arm 10. A front lay support shaft 14 is fixed to the movable end of the arm 10, with the front lay support shaft 14 extending through the movable end thereof in parallel relation to the support shaft 13. A projection 15 projects horizontally from the movable end portion of the arm 10. A support bar 16, as best shown in FIG. 3, is parallel to the front lay support shaft 14 and has an inverse L-shaped cross-section pivotally attached at its central portion so that it is movable in a horizontal direction. The front end portion of an adjustment screw shaft 18, as shown in FIG. 1, is screw-engaged with a female screw member 17 at one end of the front lay support shaft 14 and is inserted into a pin hole formed in one end of the support bar 16. Between the other end of the front lay support shaft 14 and the support bar 16, there is provided a compression coil spring 19 for exerting a counterclockwise rotational force on the support bar 16. On the vertical surface of the support bar 16, a plurality of rectangular plate-like front lays 20 are screw-fastened so that they are dephased with the conveying belts 1. On the respective front lays 20, guides 21, each having a tapered surface at the lower end, are screw-fastened. When the signatures which have been conveyed by the conveying belts 1 reach the chopper device, their front ends get under the tapered portions of the guides 21, and then are brought into contact with the front lays 20 and are stopped thereat. By applying rotational manipulation to the adjustment screw shaft 18, parallelism between the front edge of the signature and the front lay 20 is finely adjusted on the basis of the cooperative action of the screw shaft 18 and the compression coil spring 19. In addition, by manipulating the manipulation member 12, the front lays 20 rise through movement of the arm 10, permitting the signatures to pass thereunder without causing them to be in contact with the front lays 20.

Further, a chamfered portion of an arm shaft 22 is rotatably supported by the subframe 5 in parallel relation to the square stays 4, and a blade arm 23 is fixed thereto in such a manner that the movable end portion of the blade arm faces above the mouthpieces 7. At the movable end of the blade arm 23, the laterally elongated, rectangular chopper blade 24, which is formed of a thin plate, is fixed thereto by a forcing plate 26 using bolts passing through a bar 25. The arm shaft 22, is drivingly connected to a motor through a crank mechanism (not shown). By driving the arm shaft 22 from the motor, the blade arm 23 fluctuates between positions indicated by solid and dotted lines in FIG. 2, that is, the chopper blade 24 moves upwardly and downwardly. Namely, when the front end edge of a certain signature, which has been conveyed while being held between the upper and lower belts of the conveying belts 1, is brought into contact with the front lays 20 and is stopped thereat, the chopper blade 24 lowers toward the centerline of the signature, causing the signature to be forced through the gap formed in the mouthpieces 7 and then gripped between both the jaw rollers 8 and 9 while being half-folded. In addition, below the jaw rollers 8 and 9, a pair of rollers and a fan wheel (which are not shown) are disposed. Thus, the signature is gripped between the jaw rollers 8 and 9 and drawn out below by the pair of rollers provided therebelow and delivered onto each paddle of the fan wheel, thereby conveying the signature through rotation of the fan wheel for delivery onto the delivery conveyor.

The chopper device 2 is further provided with a sheet hold device which holds the signature immediately before it is brought into contact with the front lay 20 in order to brake it. Another sheet hold device holds the signature while being half-folded in accordance with the downward movement of the chopper blade 24, so that it does not leap or jump. On the support bar 16 which supports the front lays 20, a plurality of adjustment screw shafts 28 each having a knob 27 are rotatably connected in vertical relation thereto. These adjustment screw shafts 28 are screw-engaged with a plurality of respective screw holes in an adjustment bar 29 formed as a long strip. By manually rotating each adjustment screw shaft 28 with the knob 27, the heights of the adjustment bar 29 may be locally adjusted. A tubular nut 30 is screw-engaged with each adjustment screw shaft 28. The tubular nut 30 fixes each adjustment screw shaft 28 after the height adjustment of the bar 29 is completed. A plurality of L-shaped brush supports 31 are screw-fastened to the adjustment bar 29 in correspondence with the respective front lays 20. Deceleration brushes 32 located on the respective brush supports 31, are provided with a plurality of vertically oriented plastic bristles so that the front ends of the deceleration brushes 32 are caused to slide on the signature surface. By employing such an arrangement, the front end of the signature conveyed by the conveying belt 1 is held immediately before it is brought into contact with the front lay 20, whereby the running of the signature is braked, with the result that an impact due to contact of the signature with the front lay 20 is softened. It is to be noted that the pressing force of the deceleration brush 32 applied to the signature is adjusted by rotating the adjustment screw shaft 28.

Over the left and right upper square stays 4, a gate-shaped frame 33 is bridged between the bottom portions thereof. A pair of support arms 35 joined by a stay 34 are projected horizontally from the central portion of the horizontal member provided at the upper end of the frame 33, so that the support arms 35 are positioned above both sides of the rectangular hole in the plate 6. A brush support frame 36 is integrally formed with a pair of left and right channel-shaped frame bodies **36*a* which are opened at their lower ends and pins 36*b* and 36*c* are fixed at the front and rear sides of the upper horizontal member of the channel-shaped frame bodies 36*a*. Joint members 36*d* and 36*e* join front and rear lower ends of the pair of channel-shaped frame bodies 36*a*, respectively, and right and left brush supports 36*f* are joined adjacent the lower ends of the pair of channel-shaped frame bodies 36*a*, respectively. A pair of forked levers 39 and 40 are pivotally supported at two respective portions at the front and rear sides of the support arm 35 through pins 37 and 38, respectively, and the ends of the forked levers 39 and 40 are rotatably joined with the pins 36*b* and 36*c*, respectively, of the brush support frame 36. The left and right frame bodies 36*a* of the brush support frame 36 are disposed so that the brush supports 36*f* are positioned in parallel relation above both sides of the fold line of the signature. Chopper brushes 41 are composed of a large number of plastic bristles which are integrally formed on the brush supports 36***f*, respectively. By applying rotational manipulation to a handle 42 on the pin 37 between the positions indicated by the solid and dotted lines in FIG. 3, the brush support frame 36 effects parallel movement through a pressure regulator 43 (which will be described later), as indicated by the solid and the dotted lines, to move upwardly and downwardly. By this movement, the lower edge of each chopper brush 41 may be alternatively in contact with the surface of the signature or away therefrom.

Figure 4:
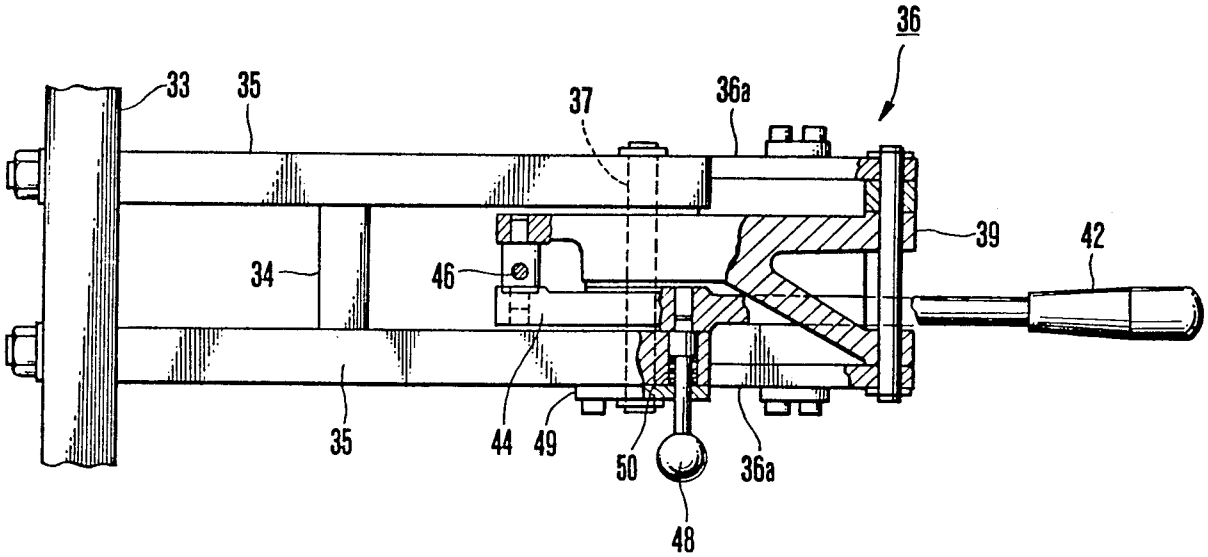
FIG. 4 is a plan view showing the same portions of the invention as those shown in FIG. 3.

The pressure regulator 43 will now be described. The forked lever 39 and a lever 44 are loosely fitted to the pin 37 so that they are adjacent to each other. The handle 42 is connected to the lever 44. Upper and lower projections are integrally formed with the forked lever 39 and lever 44, respectively, and extend leftwardly of the pin 37 as viewed in FIG. 3. A spacing between the upper and lower projections is joined by an adjustment screw shaft 46 with an adjuster knob 45. With such an arrangement, by applying rotational manipulation to the handle 42, the forked lever 39 moves in cooperation with the lever 44 and the adjustment screw shaft 46. In addition, by manually rotating the adjustment screw shaft 46 by use of the adjuster knob 45, the phase relationship between the forked lever 39 and the lever 44 is adjusted, whereby the contact pressure of the brush 41 to the surface of the signature is adjusted accordingly. A stopper 47 serves to limit the rotational movement of the lever 44 to be stopped at a preselected angle, thereby causing the chopper brushes 41 to be stopped at a preselected lower limit. A support arm handle 48 shown in FIG. 4 is slidably fitted into a handle hole of the support arm 35 in such a manner that a distal end portion of the support arm handle 48 can be inserted into a hole of the lever 44 or drawn out therefrom. Between the support arm handle 48 and a stop plate 49 which is fixed to the support arm 35, a compression coil spring 50 is provided. The lever 44 is fixed because of the distal end portion of the handle being acted on by the spring force, so that, accordingly, the handle 42 cannot be moved. However, rotational manipulation of the handle 42 is permitted by pulling or drawing out the support arm handle 48 against the spring force. In addition, a limit switch 51, shown in FIG. 3, is mounted on the frame 33 through a switch plate 52. An actuator 53 for the limit switch 51 is in contact with a cam 54 provided on the forked lever 40. When the chopper brushes 41 are away from the surface of the signature, the limit switch 51 is actuated, thus preventing the starting of the machine.

The operation of the chopper device thus configured will now be described. When it is unnecessary to perform chopper folding, the manipulation lever 12 is manipulated to rotate the arm 10, so that the front lays 20 and the deceleration brushes 32 are positioned away from the conveying belts 1. This is accomplished by pulling out the support arm handle 48 thereby allowing the handle 42 to be rotated to the position indicated by dotted lines in FIG. 3. This then causes the chopper brushes 41 to be positioned so that they are away from the conveying belts 1. In such a condition, when the printing press is caused to run, the signatures which have been subjectd to printing and parallel folding are conveyed while being supported by the upper and lower belts of the conveying belts 1. Thus, they pass through the front lays 20 and are successively delivered onto the delivery conveyor through the fan wheel.

On the other hand, when it is required to perform chopper folding, the manipulation member 12 is manipulated to rotate the arm 10 counterclockwise, as illustrated in FIG. 3, thereby causing it to take the position shown. Thus, the lower surfaces of the front lays 20 are flush with the contact surfaces of the upper and lower belts of the conveying belts 1, and the lower ends of the deceleration brushes 32 are also flush therewith. Then, when the support arm handle 48 is pulled out and the handle 42 is rotated from the phantom position to the position indicated by the solid line, the brush support frame 36 lowers in such a manner that it shifts in parallel relation from the position indicated by the solid and dotted lines to the position indicated by the solid line. As a result, the lower ends of the chopper brushes 41 are flush with the contact surfaces of the upper and lower belts of the conveying belts 1. When the printing press is caused to run, signatures which are subjected to printing and parallel folding are conveyed while being supported by the upper and lower belts of the conveying belts 1. When the leading edge of the signature approaches the front ends of the front lays 20, the running of the signature is braked due to the holding effect by the deceleration brushes 32. Thus, the signature gently hits the front lays 20 because of contact with the tapered portion of the guide 21 while the signatures are being decelerated by the brushes before they are stopped at the front lays 20. Simultaneously with this, the chopper blade 24 lowers toward the position of the fold portion of the signature, so as to force the fold portion of the signature into the gap between the mouthpieces 7, and thereby cause the signature to be gripped between the jaw rollers 8 and 9. Then, the fold portion of the signature is lowered by the jaw rollers 8 and 9 and both the side portions of the signature shift in the sheet width direction toward the chopper blade 24 while it is held by the upper and lower belts of the conveying belts 1. When the end of chopper folding approaches, the signature is released from the condition where it is supported by the conveying belts 1. However, since the chopper brushes 41 are provided in the chopper device according to the present invention, both side edges of the signature are held by the chopper brushes 41, whereby the signature slides under the chopper brushes 41 without leap or jump until it has been drawn into the gap between the mouthpieces 7. Accordingly, there is no possibility that the signature is brough into contact with the bar 25 and the plate 26, causing it to be thereby strained or broken. The signature thus gripped by the jaw rollers 8 and 9 is drawn out downwardly by the pair of rollers provided further below and is delivered between the paddles of a fan wheel, whereupon the signature is conveyed, by the rotation of the fan wheel, and then delivered onto the delivery conveyor.

When the thickness of the signature is changed, the tubular nut 30 is loosened and rotational manipulation is applied to the adjustment screw shaft 28. Thus, the deceleration brushes 32 move upwardly or downwardly, so that the contact pressure of the deceleration brushes 32 on the signature is adjusted, thus making it possible to cope with a new signature specification.

When rotational manipulation is applied to the adjustment screw shaft 46 by hand turning the adjuster knob 45, the phase relationship between the forked lever 39 and the lever 44 varies, so that the forked levers 39 and 40 slightly rotate, allowing the height of the chopper brushes to be finely adjusted. Accordingly, the contact pressure of the chopper brushes 41 to the signature is adjusted, thus making it possible to cope with the new signature specification.

What is claimed is:

1. A chopper device for use in a folder for applying chopper folding to a signature, which is subjected to parallel folding at a parallel folding device of said folder and then is conveyed through a conveying path having a conveying belt, in a direction perpendicular to the parallel folding direction, comprising:

an opening and a mouthpiece disposed below the conveying path, said opening being elongated in the conveying direction;

a chopper blade which lowers when said signature is stopped at a predetermined position for forcing said signature into said opening;

chopper blade moving means for moving said chopper blade upwardly and downwardly;

a pair of rollers disposed below said opening, said pair of rollers being in contact with each other, respectively, in order to grip said signature forced into said opening by said chopper blade and then to deliver said signature to a delivery conveyor; and signature edge holding means provided on both longitudinal sides of said opening in parallel relation to said chopper blade, for slidably holding both side portions of said signature being chopper folded when said signature is lowered by said pair of rollers through said opening.

2. A chopper device as set forth in claim 1 wherein said signature edge holding means comprises brushes provided with a plurality of bristles, said plurality of bristles having lower ends which slidably contact with a surface of said signature which is being chopper folded.

3. A chopper device as set forth in claim 2, further comprising brush moving means for moving said brushes upwardly and downwardly in mutual parallel relation to change the pressing force of said plurality of bristles of said brushes on said surface of said signature.

4. A chopper device as set forth in claim 3, wherein said brush moving means comprises right and left frames each having four frame members assembled in the form of a square having upper and lower frame members, said brushes being attached to the lower frame members of each of said right and left frames; two levers each having a first and a second end, each said first end of said two levers being each respectively rotatably attached to an end portion of said upper frame member of each of said right and left frames by pins, and each said second end of said two levers being each respectively rotatably attached to a fixed member, so that rotation of each of said levers respectively about said pins causes said brushes to move upwardly and downwardly; said chopper blade moving means being provided with an arm having a first and a second end, said first end of said arm being rotatably supported at a position outside of said conveying path, said second end of said arm projecting toward a space between said right and left frames through a central portion of one of said right and left frames, said chopper blade being attached to an edge portion of said second end of said arm.

5. A chopper device as set forth in claim 4, wherein said brush moving means is provided with a handle for manually rotating one of said levers about said corresponding pin.

6. A chopper device as set forth in claim 5, wherein said brush moving means is further provided with an adjusting means adjustably connected between said one of said levers and said handle, for finely adjusting said pressing force of said brushes on said surface of said signature.

7. A chopper device as set forth in claim 5, wherein said brush moving means is further provided with means for stopping rotation of said levers at a preset position.

8. A chopper device as set forth in claim 5, wherein said brush moving means is further provided with means for inhibiting manipulation of said handle when chopper folding is not to be performed and permitting manipulation of said handle when chopper folding is to be performed.

* * * * *

UNITED STATES PATENT AND TRADEMARK OFFICE

CERTIFICATE OF CORRECTION

PATENT NO. : 4,746,108

DATED : May 24, 1988

INVENTOR(S) : Hirayama et al

It is certified that error appears in the above-identified patent and that said Letters Patent is hereby corrected as shown below:

Column 6, line 50, delete "brough" and insert ---- brought ----.

In the Abstract

Line 9, delete "stopper" and insert ---- stopped ----.

Line 12, delete "nd" and insert ---- and -----.

Signed and Sealed this

Sixth Day of December, 1988

*Attest:*

*Attesting Officer*

DONALD J. QUIGG

*Commissioner of Patents and Trademarks*